US005717382A

United States Patent [19]

Cooper

[11] Patent Number: 5,717,382

[45] Date of Patent: Feb. 10, 1998

[54] DEVICE FOR USE IN DETECTING THE UNAUTHORIZED REMOVAL OF AN ARTICLE OF COMMERCE FROM A STORE OR OTHER BUSINESS ESTABLISHMENT

[75] Inventor: William J. Cooper, Woonsocket, R.I.

[73] Assignee: Avery Dennison Corporation, Pasadena, Calif.

[21] Appl. No.: 616,084

[22] Filed: Mar. 15, 1996

[51] Int. Cl.[6] ..... G08B 13/14

[52] U.S. Cl. ..... 340/572; 340/551; 340/568

[58] Field of Search ..... 340/551, 572, 340/568, 825.54, 825.36

[56] References Cited

U.S. PATENT DOCUMENTS

| | | | |
|---|---|---|---|
| 3,983,552 | 9/1976 | Bakeman, Jr. et al. | 340/572 |
| 4,603,326 | 7/1986 | Freed | 340/572 |
| 4,857,891 | 8/1989 | Heltemes | 340/551 |
| 4,899,134 | 2/1990 | Wheeless, Jr. | 340/573 |
| 4,935,724 | 6/1990 | Smith | 340/551 |
| 5,191,315 | 3/1993 | Cordery et al. | 340/572 |
| 5,206,065 | 4/1993 | Rippingale et al. | 428/98 |
| 5,268,043 | 12/1993 | McCowen | 148/310 |
| 5,354,521 | 10/1994 | Goodman | 264/429 |
| 5,577,147 | 11/1996 | Arroyo et al. | 385/109 |

*Primary Examiner*—Jeffery Hofsass
*Assistant Examiner*—Benjamin C. Lee
*Attorney, Agent, or Firm*—Kriegsman & Kriegsman

[57] ABSTRACT

A device for use in detecting the unauthorized removal of an article of commerce from a store or other business establishment. In one embodiment, the device comprises a fastener of the type constructed for use in attaching a tag to the article of commerce. The fastener includes a first end, a second end and a filament interconnecting the first end and the second end. The first end is shaped to define a cross-bar which can be inserted through the tag and then through the article of commerce. The second end is sized and shaped to prevent the tag from being pulled off the filament. The fastener is made of plastic and includes one or more magnetizable particles embedded therewithin. The particles are initially placed in a magnetized state. Consequently, when an article, including the fastener, passes through a magnetic field detector, a signal will be emitted unless the particles have been demagnetized.

12 Claims, 1 Drawing Sheet

DEVICE FOR USE IN DETECTING THE UNAUTHORIZED REMOVAL OF AN ARTICLE OF COMMERCE FROM A STORE OR OTHER BUSINESS ESTABLISHMENT

BACKGROUND OF THE INVENTION

The present invention relates to a device for use in detecting the unauthorized removal of an article of commerce from a store or other business establishment.

Plastic fasteners of the type commonly used, for example, to attach merchandise tags to articles of commerce, such as articles of clothing, are well known and are widely used in the retail industry. Typically, such fasteners comprise an elongated member having a first end shaped to define a cross-bar (also commonly referred to as a "T-bar"), a second end, and a thin filament portion interconnecting the cross-bar and the second end. In use, the cross-bar is inserted first through a tag and then through a desired piece of fabric. The second end is appropriately sized and shaped to keep the tag from being pulled off the filament portion.

Typically, such fasteners are mass-produced by a molding process in either one of two different forms known as fastener stock. One type of fastener stock, which is disclosed in commonly assigned U.S. Pat. No. 3,103,666 and which is incorporated herein by reference, comprises a plurality of fasteners joined together at their respective cross-bars by an orthogonally disposed runner bar. The other type of fastener stock, which is disclosed in commonly-assigned U.S. Pat. No. 4,955,475 and which is incorporated herein by reference, comprises a plurality of fasteners arranged in an end-to-end alignment, the ends of successive fasteners being joined together by severable connectors so as to form a continuously connected fastener stock.

The dispensing of individual fasteners from fastener stock into desired articles of commerce is typically accomplished using an apparatus commonly referred to as a "tagger gun." Examples of tagger guns are illustrated in commonly-assigned U.S. Pat. Nos. 5,320,269, 5,024,365, 4,121,487, and 4,456,161, all of which are incorporated herein by reference. Typically, a tagger gun includes (a) a hollow needle having a longitudinal slot extending across its length; (b) means for separating an individual cross-bar from the remainder of the fastener stock; and (c) means for feeding the individual cross-bar through the hollow, slotted needle and the desired article of commerce. Connections, if any, between the ends of adjacent fasteners are severed by pulling the tagger gun away from the article of commerce after the cross-bar of one of the fasteners has been inserted thereinto.

Although plastic fasteners of the type described above work well in the attachment of merchandise tags to articles of commerce, it is nonetheless known that certain unscrupulous consumers, on occasion, engage in the practice of "ticket switching" wherein the price tag for a low-priced item is switched with the price tag for a desired high-priced item using the plastic fastener from either the low-priced or the high-priced item. Various approaches to this problem have been devised. See e.g., commonly-assigned U.S. Pat. No. 5,321,872, incorporated herein by reference, wherein a tamper-resistant plastic fastener is disclosed.

Although unrelated to the use of plastic fasteners, another common problem suffered by merchants is the theft of their merchandise. One approach that has been adopted by many merchants is the attachment of theft-detection devices to their articles of commerce. Such devices, which are typically quite large and conspicuous in appearance, usually comprise an elongated strip of magnetizable material which is initially magnetized and which will cause an audible signal or alarm to be emitted from a magnetic field detector if the article is moved past the detector without having been demagnetized or if the magnetizable strip has not been removed from the article. Typically, the detector is located at the egress of the store so as to permit authorized personnel to demagnetize or remove the elongated magnetizable strip following the purchase of the item and before the article is moved past the detector.

SUMMARY OF THE INVENTION

It is an object of the present invention to provide a device for use in detecting the unauthorized removal of an article of commerce from a store or other business establishment.

In a first embodiment of the invention, the device comprises a fastener which can be used in attaching a tag to an article of commerce, the fastener comprising an elongated unitary member having a first end, a second end, and a filament, said filament interconnecting said first end and said second end, said first end being shaped to define a cross-bar which can be inserted through an article of commerce, said second end being sized and shaped to prevent said filament from being pulled completely through the article of commerce, said fastener being made of plastic and including one or more magnetizable particles embedded therewithin, the magnetizable particles being used in conjunction with a magnetic field sensor.

In a second embodiment of the invention, the device comprises an elongated member which can be inserted into an article and which is made of plastic and has one or more magnetizable particles embedded therewithin.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitutes a part of this specification, illustrate various embodiments of the invention and, together with the description, serve to explain the principles of the invention. In the drawings wherein like reference numerals represent like parts.

DETAILED DESCRIPTION OF A PREFERRED EMBODIMENT

Figure 1:
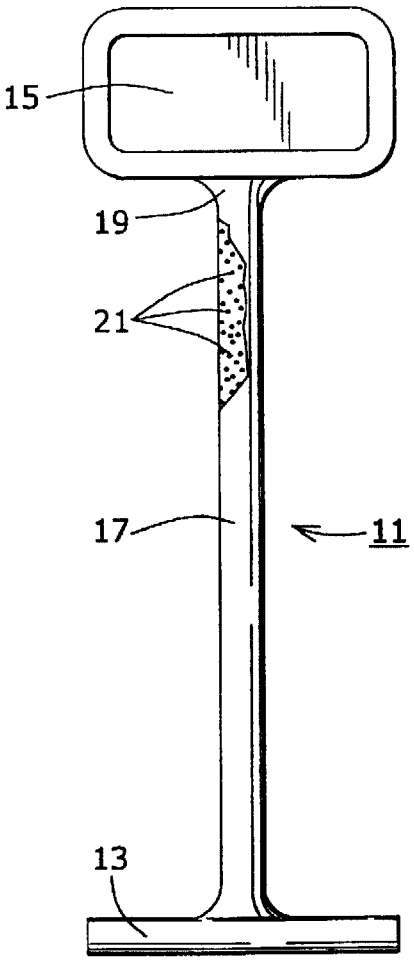
FIG. 1 is an enlarged front view, broken away in part, of a first embodiment of a device constructed according to the teachings of the present invention for use in detecting the unauthorized removal of an article of commerce from a store or other business establishment.
Figure 2:
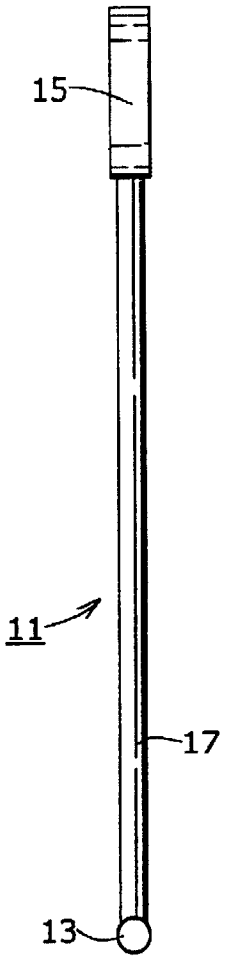
FIG. 2 is a right side view of the device shown in FIG. 1.

Referring now to FIGS. 1 and 2, there are shown enlarged front and right side views, respectively, of a first embodiment of a device constructed according to the teachings of the present invention for use in detecting the unauthorized removal of an article of commerce from a store or other business establishment, the device being represented generally by reference numeral 11.

Device 11 is generally in the shape of a fastener of the type commonly used to attach a tag to a piece of fabric and comprises an elongated unitary member having a first end which is shaped to define a cross-bar 13, a second end which is shaped to define a paddle 15, and a filament 17 which interconnects cross-bar 13 and paddle 15. Cross-bar 13 is appropriately sized and shaped to be dispensed through an article of commerce using a tagger gun having a hollow slotted needle. Paddle 15 is appropriately sized and shaped to prevent flexible filament 17 from being pulled completely through an article of commerce through which cross-bar 13 has previously been inserted.

Device 11 is constructed of a plastic material 19 which has one or more magnetizable particles 21 embedded therewithin. Plastic material 19 is preferably a material such as polypropylene or nylon. Magnetizable particles 21 are preferably a material capable of magnetization and demagnetization, such as iron filings.

Device 11 can be made by introducing magnetizable particles 21 into a molten form of plastic 19. The mixture of molten plastic 19 and magnetizable particles 21 can then be molded into the size and shape of device 11 through common molding techniques. As can readily be appreciated, mass production of device 11 may be achieved by molding a plurality of fasteners in either the form of continuously connected fastener stock or fastener stock of the type having an orthogonally disposed runner bar.

In use, device 11 functions as part of a theft-detection or inventory control system in the following manner: Using well-known techniques, magnetic particles 21 in device 11 are initially magnetized, creating a magnetic field about device 11 of a particular signature. Fastener 11 is then secured to a desired article of commerce by inserting cross-bar 13 through the article. Preferably a tagger gun is used to insert cross-bar 13 through the article.

Typically, a magnetic field sensor is located at the egress of the room where the article is located. If the article is moved past the magnetic field sensor, the sensor will detect the particular signature of the magnetic field of device 11. The magnetic field sensor, upon detecting the specific magnetic field of fastener 11, will then emit a visual and/or audio signal. To preclude the sensor from activating the alarm, if removal of the article is authorized a device is provided which will enable authorized personnel to demagnetize device 11.

It should be noted that paddle 15 may be sized and shaped so as to allow for bar coding of fastener 11.

Instead of being in the shape of a paddle, the second end of the fastener may be in the shape of a cross-bar or any other shape which will prevent a tag from being pulled off of the filament at that end.

As can be appreciated, device 11 serves as a fastener and also as a theft detection device.

Figure 3:
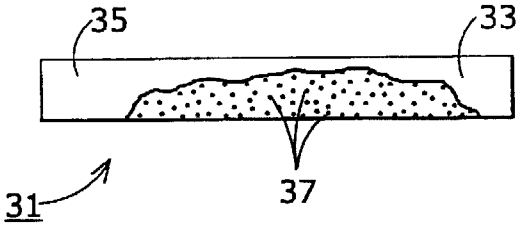
FIG. 3 is an enlarged front view, broken away in part, of a second embodiment of a device constructed according to the teachings of the present invention for use in detecting the unauthorized removal of an article of commerce from a store or other business establishment.
Figure 4:
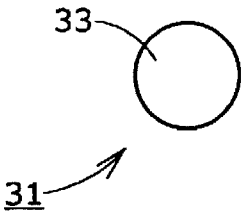
FIG. 4 is a right side view of the device shown in FIG. 3.

Referring now to FIGS. 3 and 4, there are shown enlarged front and right side views, respectively, of a second embodiment of a device constructed according to the teachings of the present invention for use in detecting the theft of an article of commerce, the device being represented generally by reference numeral 31.

Device 31 comprises an elongated member 33 which is identical in size and shape to cross-bar 13 of device 11 so that it can be inserted into an article of commerce using a tagger gun having a hollow slotted needle.

Device 31 is identical in composition to device 11 in that it is constructed of a plastic material 35, such as polypropylene or nylon, and which has one or more magnetizable particles 37, such as iron filings, embedded therewithin.

Device 31 may be made and used in a manner similar to that described above in connection with device 11. Because of its compact size and shape, device 31 is particularly well-suited to be inserted into the interior spaces of an article of commerce (e.g., inside a cuff, inside a pocket, between an inner piece and an outer piece of fabric which have been sewn together, etc.). In this manner, device 31 can be effectively concealed within an article of commerce. Moreover, because of its small size, it may not be necessary for device 31, where concealed, to be removed from the article of commerce so long as it is demagnetized, at the time of purchase, to indicate that the article has been duly purchased.

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A device for use in detecting the unauthorized removal of an article of commerce from a store or other business establishment, said device comprising a plastic member, said plastic member having one or more magnetizable particles embedded therewithin, said plastic member being a cross-bar of a plastic fastener of the type comprising a flexible filament having a cross-bar at one end thereof for insertion through an article of commerce using a tagger gun having a hollow slotted needle.

2. The device as claimed in claim 1 wherein the plastic is polypropylene.

3. The device as claimed in claim 1 wherein said one or more magnetizable particles are iron filings.

4. A device for use in detecting the unauthorized removal of an article of commerce from a store or other business establishment, said device comprising a fastener of the type which can be used to secure a tag to said article of commerce, the fastener comprising an elongated unitary member having a first end, a second end, and a filament, said filament interconnecting said first end and said second end, said first end being shaped to define a cross-bar insertable through an article of commerce using a tagger gun having a hollow slotted needle, said second end being sized and shaped to prevent said filament from being pulled completely through the article of commerce, said elongated unitary member being made of plastic and having one or more magnetizable particles embedded therewithin.

5. The device as claimed in claim 4 wherein the plastic is polypropylene.

6. The device as claimed in claim 4 wherein said second end is shaped to define a paddle.

7. The device as claimed in claim 4 wherein the plastic is nylon.

8. The device as claimed in claim 4 wherein said magnetizable particles are iron filings.

9. A method for constructing a device for use in detecting the unauthorized removal of an article of commerce, said method comprising the steps of:

a. mixing one or more magnetizable particles together with plastic to form a molding compound; and b. molding said molding compound into a fastener of the type which includes an elongated unitary member having a first end, a second end, and a filament, the filament interconnecting the first end and the second end, the first end being shaped to define a cross-bar insertable through an article of commerce using a tagger gun having a hollow slotted needle, the second end being sized and shaped to prevent the filament from being pulled completely through the article of commerce.

10. The method as claimed in claim 9 wherein said second end is shaped to define a paddle.

11. A method for constructing a device for use in detecting the theft of an article of commerce, said method comprising the steps of:

a. mix together one or more magnetizable particles with plastic to form a molding compound; and b. molding said molding compound into an elongated member being a cross-bar of a plastic fastener of the type comprising a flexible filament having a cross-bar at one end thereof for insertion through an article of commerce using a tagger gun having a hollow slotted needle.

12. The method as claimed in claim 11 wherein said elongated member is insertable into an article of commerce using a tagging gun.

* * * * *